US006233772B1

(12) United States Patent
McClain et al.

(10) Patent No.: US 6,233,772 B1
(45) Date of Patent: May 22, 2001

(54) CARBON DIOXIDE CLEANING APPARATUS WITH ROTATING BASKET AND EXTERNAL DRIVE

(75) Inventors: James B. McClain, Raleigh, NC (US); Gary Schrebe, Midland, MI (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/306,360

(22) Filed: May 6, 1999

Related U.S. Application Data

(63) Continuation-in-part of application No. 09/047,013, filed on Mar. 24, 1998, now Pat. No. 6,089,430.

(51) Int. Cl.[7] ..... D06B 23/18

(52) U.S. Cl. ..... 8/159; 68/18 R; 68/18 C; 277/401

(58) Field of Search ..... 68/18 R, 5 C, 68/18 C, 18 F; 277/401; 8/158, 159

(56) References Cited

U.S. PATENT DOCUMENTS

| | | | | |
|---|---|---|---|---|
| 2,033,403 | * | 3/1936 | Smittle | 277/401 |
| 2,528,594 | * | 11/1950 | Kahn . | |
| 2,555,492 | * | 6/1951 | Kidney | 277/401 |
| 2,662,480 | * | 12/1953 | Cliborn | 277/401 |
| 2,805,090 | * | 9/1957 | Creek | 277/401 |
| 3,033,577 | * | 5/1962 | Spiess | 277/401 |
| 3,034,797 | * | 5/1962 | Pike | 277/401 |
| 3,333,856 | * | 8/1967 | Voitik | 277/401 |
| 3,837,659 | * | 9/1974 | Moncrief | 277/401 |
| 4,708,711 | * | 11/1987 | Scherer . | |
| 6,012,307 | * | 1/2000 | Malchow | 68/207 |

* cited by examiner

*Primary Examiner*—Frankie L. Stinson
(74) *Attorney, Agent, or Firm*—Myers Bigel Sibley & Sajovec

(57) ABSTRACT

A cleaning apparatus adapted for cleaning fabrics, garments and the like with a carbon dioxide cleaning medium comprises a wash vessel having a wall portion; a rotating basket positioned in the wash vessel; a drive shaft penetrating the wash vessel wall portion, the shaft operatively associated with the rotating basket; a double mechanical seal connected to the wall portion with the drive shaft passing therethrough; a seal liquid reservoir; a seal liquid inlet line connected to the seal liquid reservoir and the double mechanical seal and configured to supply seal liquid to the double mechanical seal; and a pump, compressed gas line, or other pressure supply means operatively associated with the seal liquid reservoir for maintaining the pressure of seal liquid in the double mechanical seal sufficient to seal the rotating shaft when the wash vessel contains a liquid carbon dioxide cleaning medium from escape of cleaning medium around the rotating shaft. Means such as a pump operatively associated with inlet and outlet lines are provided for circulating liquid carbon dioxide cleaning medium through the wash vessel during cleaning of articles therein. A motor or other drive means is operatively associated with the drive shaft for rotating the rotating basket during cleaning of articles therein. The seal liquid is preferably selected to be compatible with (e.g., soluble in) the cleaning medium.

17 Claims, 4 Drawing Sheets

CARBON DIOXIDE CLEANING APPARATUS WITH ROTATING BASKET AND EXTERNAL DRIVE

This application is a continuation-in-part of application Ser. No. 09/047,013, filed Mar. 24, 1998, now U.S. Pat. No. 6,089,430, the disclosure of which is incorporated by reference herein in its entirety.

FIELD OF THE INVENTION

The present invention concerns washing and dry cleaning apparatus, and particularly concerns dry cleaning apparatus for use with carbon dioxide based dry cleaning systems that employ a rotating basket with an external drive.

BACKGROUND OF THE INVENTION

Numerous different apparatus for washing garments and fabrics are known. Examples of patents on washing machines include U.S. Pat. No. 1,358,168 to McCutchen, U.S. Pat. No. 1,455,378 to Allen, U.S. Pat. No. 2,357,909 to Ridge, U.S. Pat. No. 2,816,429 to Kurlancheek, and U.S. Pat. No. 3,444,710 to Gaugler. Such apparatus is, in general, adapted to home use with water-based cleaning systems.

Non-aqueous cleaning apparatus, known as "dry cleaning" apparatus, is also known. Dry cleaning employs an organic solvent such as perchloroethylene in place of an aqueous system. Dry cleaning apparatus is not, in general, employed in the home, and is instead situated at a store or central plant. Problems with convention dry-cleaning systems include the toxic nature of the solvents employed.

Carbon dioxide has been suggested as a dry cleaning medium. See, e.g., U.S. Pat. No. 4,012,194 to Maffei. To date, however, a feasible apparatus for carrying out carbon dioxide cleaning has not been provided. One apparatus is described in U.S. Pat. No. 5,467,492 to Chao et al. This apparatus has apparently been supplanted by the apparatus described in U.S. Pat. No. 5,669,251 to Townsend et al. Townsend describes a dry cleaning system having a hydraulically rotated basket that rests on roller bearings.

U.S. Pat. No. 5,267,455 to Dewees et al. describes a dry cleaning system in which carbon dioxide as a cleaning medium is transferred between vessels by means of a second purge gas such as nitrogen. The use of multiple pressurized gases makes the system considerably more complex. The system employs a rotating basket, but a disadvantage is that the basket is rotated by means of a magnet coupling.

Accordingly, there is a continued need for a feasible dry cleaning apparatus that can be used with a carbon dioxide-based cleaning medium.

SUMMARY OF THE INVENTION

A cleaning apparatus adapted for cleaning fabrics, garments and the like with a carbon dioxide cleaning medium is disclosed. The apparatus comprises:

(a) a wash vessel having a wall portion;

(b) a rotating basket positioned in the wash vessel;

(c) a drive shaft penetrating the wash vessel wall portion, the shaft operatively associated with the rotating basket;

(d) a double mechanical seal connected to the wall portion with the drive shaft passing therethrough;

(e) a seal liquid reservoir;

(f) a seal liquid inlet line connected to the seal liquid reservoir and the double mechanical seal and configured to supply seal liquid to the double mechanical seal; and (g) a pump, compressed gas line, or other pressure supply means operatively associated with the seal liquid reservoir for maintaining the pressure of seal liquid in the double mechanical seal sufficient to seal the rotating shaft when the wash vessel contains a liquid carbon dioxide cleaning medium from escape of cleaning medium around the rotating shaft.

Means such as a pump operatively associated with inlet and outlet lines are provided for circulating liquid carbon dioxide cleaning medium through the wash vessel during cleaning of articles therein. A motor or other drive means is operatively associated with the drive shaft for rotating the rotating basket during cleaning of articles therein. The seal liquid is preferably selected to be compatible with (e.g., soluble in) the cleaning medium.

The foregoing and other objects and aspects of the present invention are explained in detail in the drawings herein and the specification set forth below.

DETAILED DESCRIPTION OF THE PREFERRED EMBODIMENTS

Figure 1:
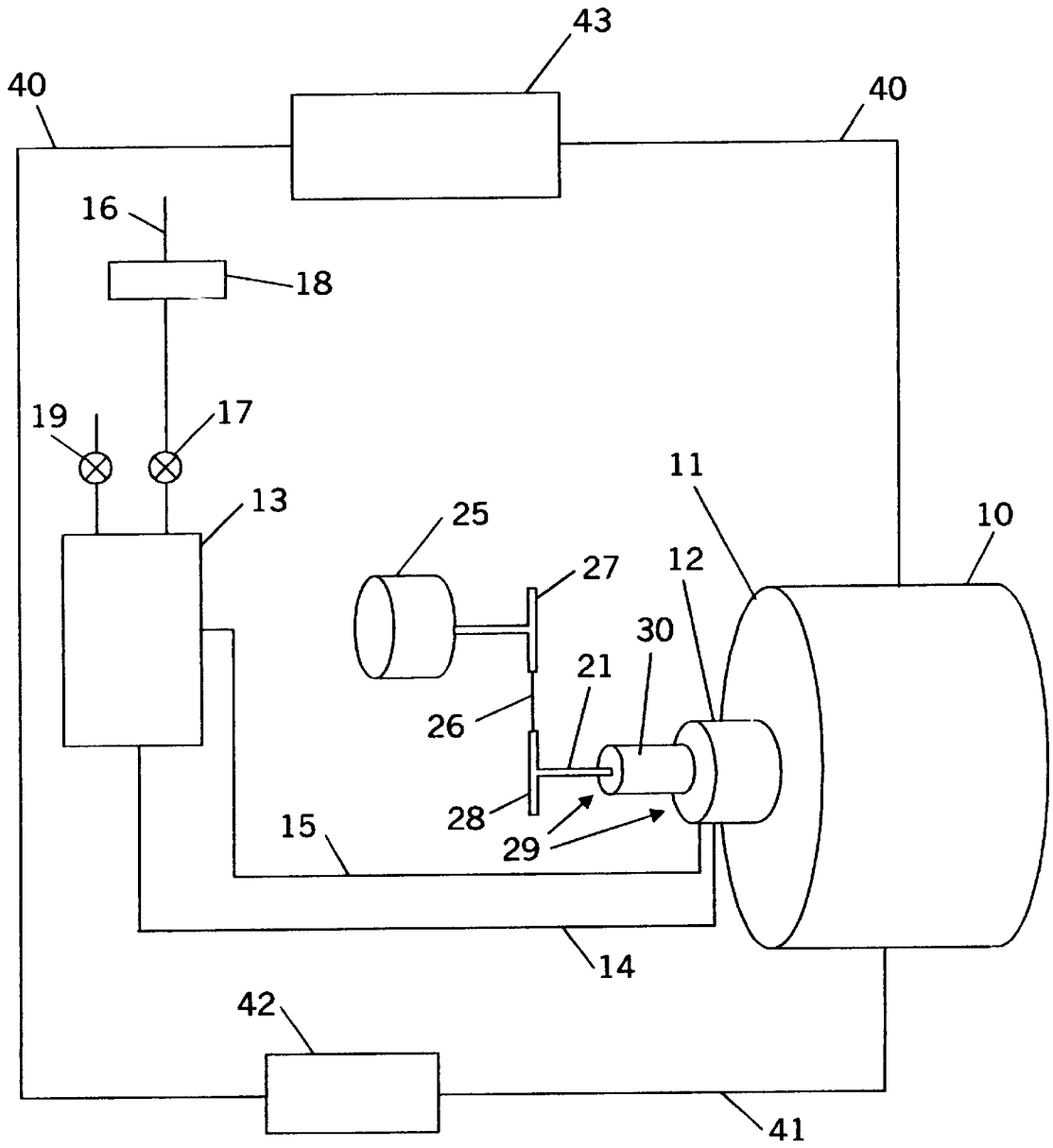
FIG. 1 is a schematic view of a carbon dioxide wash vessel with a drive shaft penetrating the back wall thereof, the drive shaft sealed with a double mechanical seal, the double mechanical, along with means for pressurizing the double mechanical seal.
Figure 2:
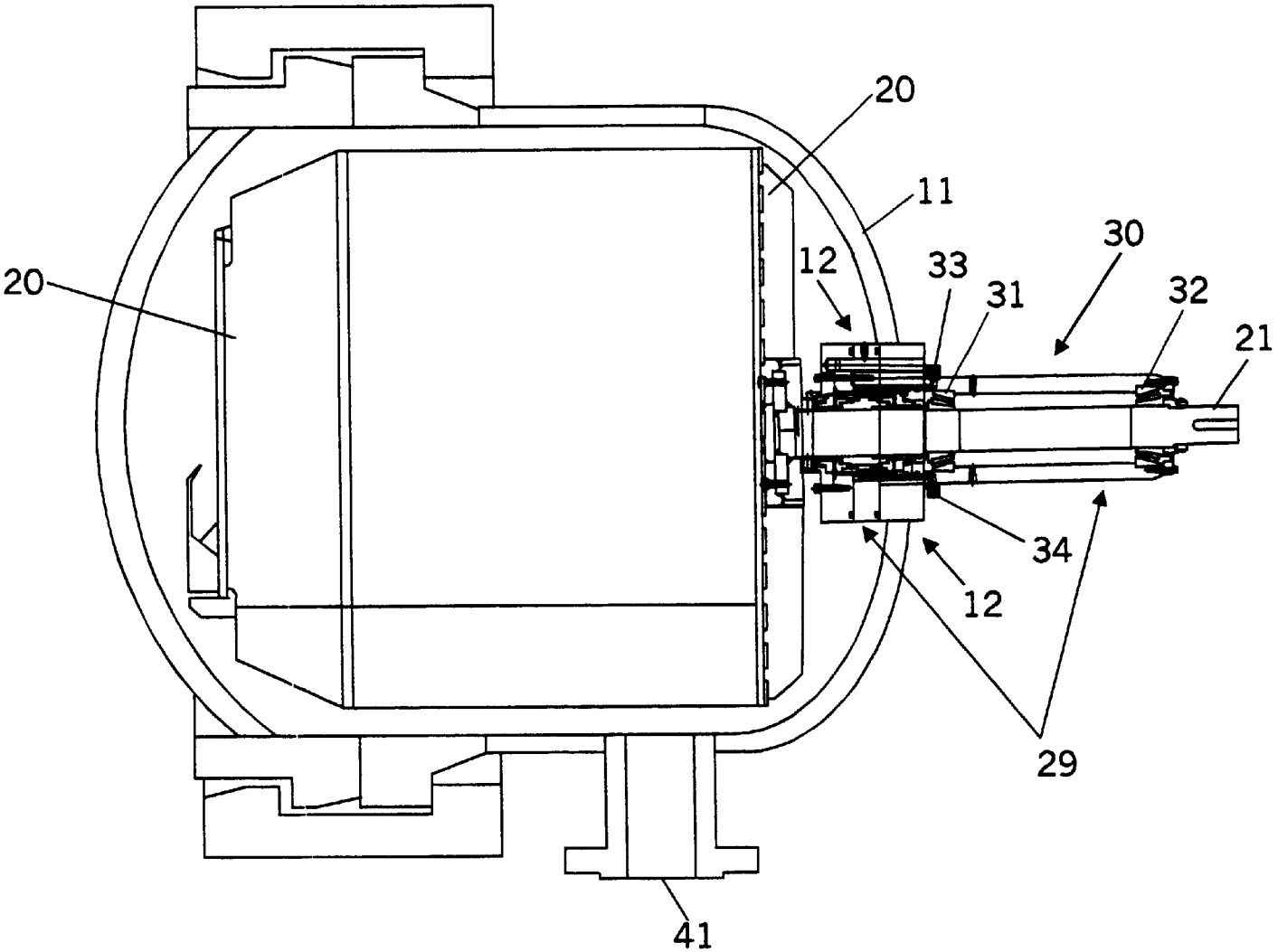
FIG. 2 is a cross-sectional view of a wash vessel of the present invention, showing the rotating basket therein, along with the double mechanical seal.

An overview of an apparatus of the present invention is provided in FIGS. 1–2. In brief, the apparatus includes a wash vessel 10 having a wall portion 11. A rotating basket 20 is positioned in the wash vessel (see FIG. 2). A drive shaft 21 penetrates the wash vessel wall portion, with the shaft operatively associated with the rotating basket. The shaft is directly connected to the rotating basket in the illustrated embodiment, but could be indirectly connected through gears, belts, chains or other drive means within the wash vessel if desired. A double mechanical seal 12 is connected to the wall portion with the drive shaft passing therethrough. A seal liquid reservoir 13 is connected to the double mechanical seal by a seal liquid inlet line 14 to supply seal liquid to the double mechanical seal via port 33 (FIG. 2). A seal liquid outlet line 15 connected to port 34 is provided to return seal liquid from the double mechanical seal to the reservoir, though the seal liquid outlet line is optional as the seal liquid could be allowed to pass from the seal directly into the wash medium, if desired. A compressed gas line 16 (e.g., compressed nitrogen at about 900 to 950 psi for a wash tank at a maximum pressure of about 875 psi) with a normally opened manual valve 17 and a pressure regulator 18 serves as a pressure supply means operatively associated with the seal liquid reservoir for maintaining the pressure of seal liquid in the double mechanical seal sufficient to seal the rotating shaft when the wash vessel contains a liquid carbon dioxide cleaning medium. A separate 1100 psi pressure relief valve 19 serves as a safety valve on the reservoir. The reservoir is supplied with a level sensor (not shown) to insure that a sufficient quantity of seal liquid is maintained therein.

A motor 25 external to the wash vessel, such as an electric motor, is drivingly connected to drive shaft 21 by means of a belt 26 and drive wheels 27, 28. A bearing cartridge 30 is connected to the wall portion and supports the drive shaft. Note that the double mechanical seal is positioned between the bearing cartridge and the rotating basket. This facilitates removal of the bearing cartridge and servicing of the bearings. Of course, any suitable drive means can be employed, including direct drives, gear drives and transmission systems, turbine drives, etc.

Figure 3:
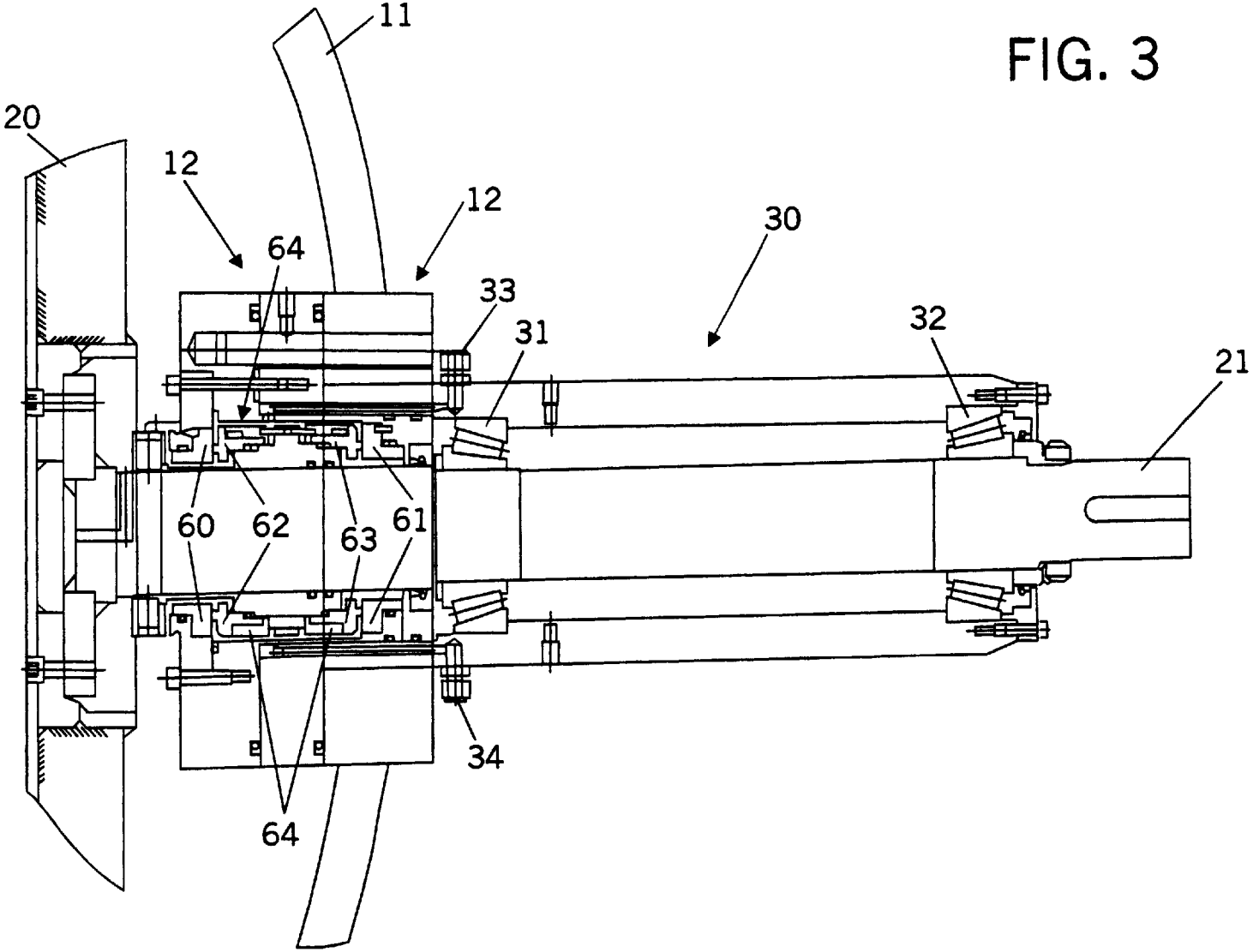
FIG. 3 is a detailed cross sectional view of the wash vessel of FIG. 2, showing the bearing cartridge and the double mechanical seal.

As shown in FIGS. 2–3, a drive shaft support in the form of an integrally formed cartridge 29 is connected to the body member back wall external to the double mechanical seal. The cartridge 29 is, in a preferred embodiment, integrally formed from a single piece of steel and contains both the bearing assembly and the double mechanical seal adjacent one another. The shaft is disposed in the cartridge holder to permit rotation of the basket 20 within the body member. The bearing assembly is a cantilevered bearing assembly, and a pair of bearings 31, 32, which may be comprised of ball bearings, roller bearings, sleeve bearings or any other suitable bearing system. Timken tapered roller bearings are preferred. Because the bearing assembly is external to the seal, the bearing assembly may be greased in a conventional manner.

In general, the double mechanical seal 12 includes an inner stator 60 and an outer stator 61, and an inner rotor 62 and an outer rotor 63. A internal space 64 between the two stators is in fluid communication with a seal liquid inlet opening 65 (which is connected to line 14 of FIG. 1) and a seal liquid outlet opening 66 (which is connected to line 15 of FIG. 2). Double mechanical seals are known. See, e.g., Intech International Technical Services, *Take the Mystery Out of Mechanical Seals*, (1994). Double mechanical seals are available from a variety of sources, such as Flowserve Fluid Sealing Division, Kalamazoo, Mich., USA.

It will be appreciated that, in addition to the seal liquid return or outlet lines described in the embodiment above and below, the other path of seal liquid release, in both embodiments, is into the wash vessel or tank itself. In general, the flow into the wash vessel is between about 0.5 to 5 or ten milliliters of seal liquid an hour.

Figure 4:
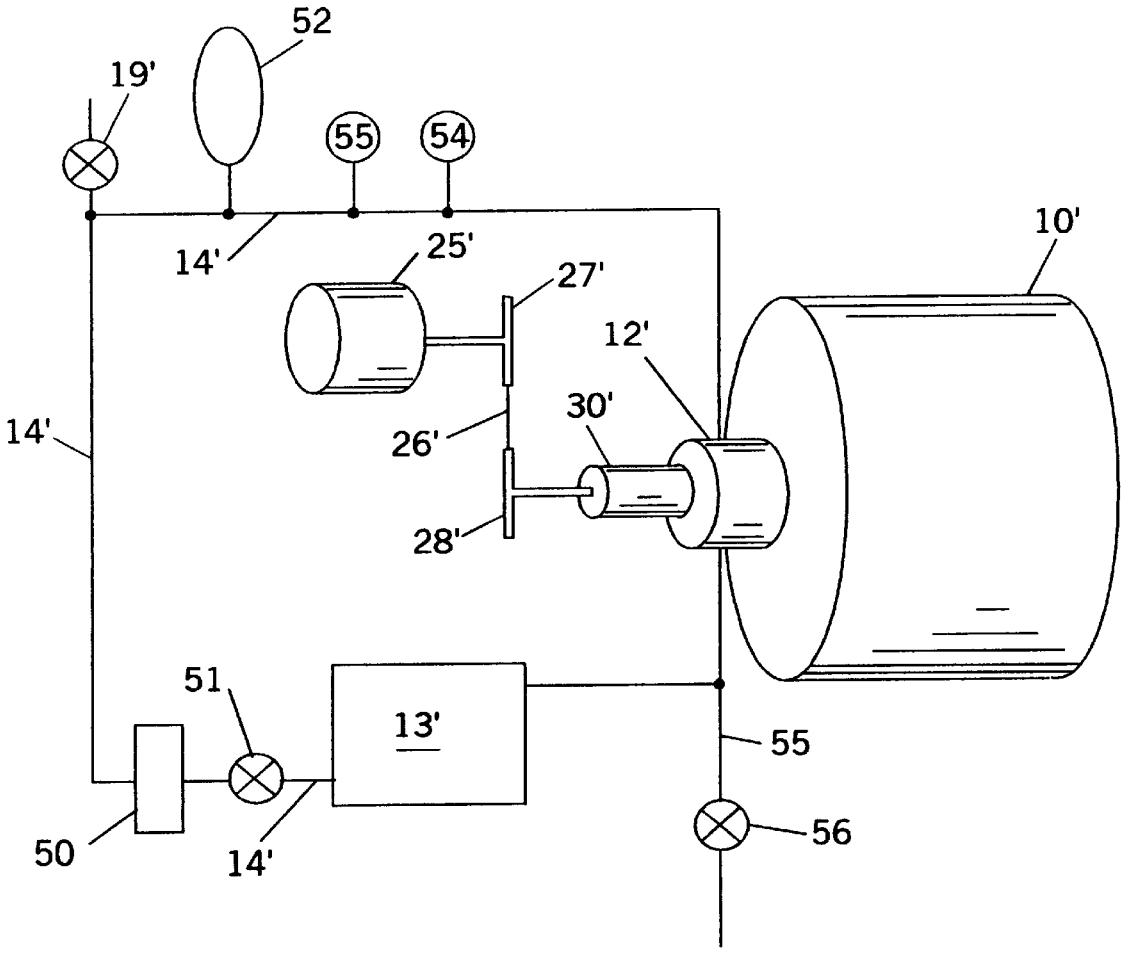
FIG. 4 is an schematic view of a carbon dioxide wash vessel with a drive shaft penetrating the back wall thereof, essentially as disclosed in FIG. 1, with an alternate arrangement for pressurizing the double mechanical seal.

An alternate embodiment of the invention where the pressure supply means comprises a pump operatively associated with the seal liquid inlet line is illustrated in FIG. 4. In FIG. 4, parts analogous to parts in FIG. 1 are assigned like numbers and reference is made to FIG. I above for the identity of the various components. The pressure relief valve 19' is a 1000 psi pressure relief valve. Pressure is applied by means of a pump 50 on line 14'. Manual valve 51 is normally open during operation. Along inlet line 14' there is an accumulator 52, a pressure indicator 53, and a pressure transducer 54. A drain line 55 is supplied with a manual drain valve 56 for emptying seal liquid from the system for servicing and the like. Obviously, numerous other pressure supply means can be employed in carrying out the present invention, including pumps, compressors, compressed gases and the like, with or without additional components such as accumulators, pressure sensors, valves, etc., with single or multiple lines provided to the double mechanical seal, in a variety of different configurations, to supply pressure to the double mechanical seal. All that is required is that sufficient pressure be provided to the seal liquid within the double mechanical seal to substantially reduce the escape of carbon dioxide cleaning medium from the wash vessel around the drive shaft. Preferably, the pressure on the seal liquid is sufficient so that, if anything, seal liquid will leak into the wash vessel from the double mechanical seal. Thus, the pressure supply means shown in FIGS. 1 and 4 are intended for the purpose of illustration, and not limitation. For example, the cleaning medium carbon dioxide liquid could be used as the pressure supply means by taking a line of cleaning medium from the pump outlet to the seal liquid reservoir, or by taking a line from the wash tank itself through a piston pump or the like to the seal liquid reservoir.

In use, the present invention provides a method of operating a cleaning apparatus adapted for cleaning fabrics, garments and the like with a liquid carbon dioxide cleaning medium, the apparatus comprising a wash vessel having a wall portion, a rotating basket positioned in the wash vessel, and a drive shaft penetrating the wash vessel wall portion, the shaft operatively associated with the rotating basket;. The method comprises providing a double mechanical seal connected to the wall portion with the drive shaft passing therethrough; filling the double mechanical seal with a seal liquid, the seal liquid comprising an organic solvent (or, with respect to the cleaning medium, an organic co-solvent); increasing the pressure in the wash vessel so that articles therein can be cleaned in a liquid carbon dioxide cleaning medium therein; and pressurizing the seal liquid for at least the time when the pressure in the wash vessel is increased, so that the escape of liquid carbon dioxide cleaning medium around the rotating shaft is reduced. The step of increasing the pressure may be carried out by filling the wash vessel with compressed gas, such as carbon dioxide gas, and/or filling the wash vessel with compressed liquid, such as the liquid carbon dioxide wash medium. The step of presssurizing the seal liquid may be carried out continuously (e.g., with pressure on the seal liquid being maintained between wash cycles while the pressure in the wash vessel is reduced to atmospheric pressure, or may be intermittent (e.g., with pressure on the seal liquid being increased when pressure in the wash vessel is increased, and pressure on the seal liquid being reduced when pressure in the wash vessel is reduced). During the washing cycle, a liquid carbon dioxide cleaning medium is circulated through the wash vessel to clean articles therein in accordance with known techniques, and the basket is rotated by rotating the drive shaft with the external drive motor as illustrated above. The liquid carbon dioxide cleaning medium may, in one preferred embodiment, contain an organic co-solvent, preferably one that is soluble in the liquid carbon dioxide. Preferably the cleaning medium also contains a surfactant. As noted herein, the seal liquid is preferably also an organic co-solvent as described herein, and is preferably soluble in the liquid carbon dioxide cleaning medium. Indeed, it is preferable that the surfactant in the cleaning medium (or at least one of the surfactants therein, where multiple surfactants are employed) is soluble in the seal liquid.

The present invention can be implemented with any system or means for supplying or circulating a liquid carbon dioxide dry-cleaning medium through the wash vessel, such as described in our co-pending patent application serial number 09/047,013, filed Mar. 24, 1998, the disclosure of which is incorporated by reference herein in its entirety. Other systems for circulating the liquid carbon dioxide dry-cleaning medium through the wash vessel that can be used in conjunction with or to carry out the present invention include those described in U.S. Pat. No. 5,850,747 to Roberts et al., U.S. Pat. No. 5,669,251 to Townsend et al., 5,676,705 to Jureller et al., and 5,683,473 to Jureller et al. The disclosures of all United States Patent references cited herein are to be incorporated by reference herein in their entirety. In general, and as illustrated in FIG. 1, such systems include a carbon dioxide cleaning medium inlet line connected to the wash vessel (typically at the top thereof), a carbon dioxide drain line 41 connected to said wash vessel (typically at the bottom thereof), and a pump 42 such as a canned motor pump (preferably a centrifugal pump) interconnecting the outlet line and the inlet line for circulating liquid carbon dioxide cleaning medium through the wash vessel. A lint filter and/or a carbon filter 43 are preferably positioned on the carbon dioxide inlet line, after the pump. Preferably, both a lint filter and a carbon filter are used, with a by-pass line equipped with valves included to by-pass the carbon filter when detergents or other chemical ingredients are added to the cleaning medium so that they are not removed by the carbon filter. A side-stream of the liquid carbon dioxide cleaning medium can be passed through the bearing cartridge through appropriate piping to cool and lubricate the bearings, particularly where the cleaning medium contains an organic co-solvent that is sufficiently heavy (i.e., has a high flash point) in sufficient amount to serve as a lubricant, though an external bearing cartridge that is simply greased in a conventional manner is currently preferred.

Any carbon dioxide liquid dry-cleaning medium can be used as the medium in the instant apparatus. See, e.g., U.S. Pat. No. 4,012,194 to Maffei. In the instant apparatus, carbon dioxide is supplied by tank, and additional ingredients can be added to the carbon dioxide in the working vessel (which may optionally be supplied with a stirrer to serve as a mixing means therein), in the wash tank, or any other suitable location in the system (or combination thereof).

In a preferred embodiment, the liquid dry-cleaning medium comprises a mixture of: (a) water, (b) carbon dioxide, (c) surfactant, and, optionally but preferably, (d) an organic co-solvent. After the contacting step, the article is separated from the liquid dry cleaning composition. Preferably, the liquid dry cleaning composition is at ambient temperature, of about 0° C. to 300° C. In one embodiment; the surfactant contains a $CO_2$-philic group; in another embodiment, the surfactant does not contain a $CO_2$-philic group.

A preferred liquid carbon dioxide dry-cleaning medium useful for carrying out the present invention typically comprises: (a) from zero or 0.1 to 10 percent (more preferably from 0.1 to 4 percent) water; (b) carbon dioxide (to balance; typically at least 30 percent); (c) surfactant (preferably from 0.1 or 0.5 percent to 5 or 10 percent); and (d) from 0.1 to 50 percent (more preferably 4 to 30 percent) of an organic co-solvent. Percentages herein are expressed as percentages by weight unless otherwise indicated. The medium is provided in liquid form at ambient, or room, temperature, which will generally be between zero and 50° Centigrade. The medium is held at a pressure that maintains it in liquid form within the specified temperature range. The washing or cleaning step is preferably carried out with the liquid medium at ambient temperature within the wash vessel, without extraneous heating or cooling of the wash vessel. All ingredients but for the carbon dioxide can be combined together to provide a detergent formulation, which is then added to the carbon dioxide to provide the dry cleaning medium. The detergent formulation can be used directly as the seal liquid, as discussed below.

Any surfactant can be used to carry out the present invention, including both surfactants that contain a $CO_2$-philic group (such as described in PCT Application WO96/27704) linked to a $CO_2$-phobic group (e.g., a lipophilic group) and surfactants that do not contain a $CO_2$-philic group (i.e., surfactants that comprise a hydrophilic group linked to a hydrophobic (typically lipophilic) group). A single surfactant may be used, or a combination of surfactants may be used. Numerous surfactants are known to those skilled in the art. Examples of suitable surfactants are given in U.S. Pat. No. 5,858,022 to Romack et al., 5,676,705 to Jureller et al., 5,683,473 to Jureller et al., and 5,683,977 to Jureller et al. The disclosures of all United States Patent references cited herein are to be incorporated herein by reference.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes in combination with additional compounds such as one or more alcohols (e.g. from 0 or 0.1 to 5% of a C1 to C15 alcohol (including diols, triols, etc.)).

As will be apparent to those skilled in the art, numerous additional ingredients can be included in the dry-cleaning medium, including detergents, bleaches, whiteners, softeners, sizing, starches, enzymes, hydrogen peroxide or a source of hydrogen peroxide, fragrances, etc.

The organic co-solvent that is employed as the seal liquid may be selected from the same group as the organic co-solvent described above which are used in the preferred liquid carbon dioxide cleaning medium (although it may be the same as or different from the organic co-solvents incorporated directly into the cleaning medium. A particularly preferred solvent for the seal liquid is ISOPAR M™ organic solvent. By employing an organic co-solvent that is soluble in carbon dioxide and compatible with the cleaning medium, leakage of the seal liquid into the wash vessel, and the increase thereof in the cleaning medium, does not interfere with the cleaning cycle and is indeed compatible with the cleaning cycle, and is not detrimental to articles cleaned within the wash vessel.

In a preferred embodiment, the organic co-solvent in said carbon dioxide cleaning medium and the organic co-solvent in said seal liquid are the same; and the liquid carbon dioxide cleaning medium further comprises a surfactant as described above, the seal liquid further comprises a surfactant as described above, and the cleaning medium surfactant and the seal liquid surfactant are the same. In this manner, the detergent formulation that is added to liquid carbon dioxide to provide the cleaning system described above can be the same formulation that is used as the seal liquid.

Articles that can be cleaned by the apparatus of the present invention are, in general, garments and fabrics (including woven and non-woven) formed from materials such as cotton, wool, silk, leather, rayon, polyester, acetate, fiberglass, furs, pelts, canvas, neoprene, etc., formed into items such as clothing, work gloves, tents, parachutes, sails, hats, tapestry, waders, rags, leather goods (e.g., boots, shoes, handbags and brief cases), etc. The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulate soils (i.e., soils containing insoluble solid components such as silicates, carbon black, etc.).

The foregoing is illustrative of the present invention, and is not to be construed as limiting thereof. The invention is defined by the following claims, with equivalents of the claims to be included therein.

That which is claimed is:

1. A cleaning apparatus adapted for cleaning fabrics and garments with a carbon dioxide cleaning medium, said apparatus comprising:

a wash vessel having a wall portion;

a rotating basket positioned in said wash vessel;

a drive shaft penetrating said wash vessel wall portion, said shaft operatively associated with said rotating basket;

a double mechanical seal connected to said wall portion with said drive shaft passing therethrough;

a seal liquid reservoir;

a seal liquid inlet line connected to said seal liquid reservoir and said double mechanical seal and configured to supply seal liquid to said double mechanical seal; and pressure supply means operatively associated with said seal liquid reservoir for maintaining the pressure of seal liquid in said double mechanical seal sufficient to seal said rotating shaft when said wash vessel contains a liquid carbon dioxide cleaning medium and for causing said seal liquid to flow into said wash vessel.

2. An apparatus according to claim 1, further comprising a bearing assembly connected to said wall portion and supporting said drive shaft.

3. An apparatus according to claim 2, wherein said double mechanical seal is positioned between said bearing assembly and said rotating basket.

4. An apparatus according to claim 3, further comprising an integral cartridge connected to said wall portion, with both said double mechanical seal and said bearing assembly contained within said integral cartridge.

5. An apparatus according to claim 1, further comprising means for supplying liquid carbon dioxide cleaning medium operatively associated with said wash vessel.

6. An apparatus according to claim 5, wherein said seal liquid reservoir comprises an organic solvent.

7. An apparatus according to claim 6, wherein said organic solvent is soluble in said liquid carbon dioxide cleaning medium.

8. An apparatus according to claim 7, wherein said liquid carbon dioxide cleaning medium comprises a surfactant, and wherein said surfactant is soluble in said organic solvent.

9. An apparatus according to claim 1, wherein said pressure supply means comprises a compressed gas supply connected to said seal liquid reservoir.

10. An apparatus according to claim 1, wherein said pressure supply means comprises a pump operatively associated with said seal liquid inlet line.

11. An apparatus according to claim 1, said apparatus further comprising:

an carbon dioxide cleaning medium inlet line connected to said wash vessel;

a carbon dioxide drain line connected to said wash vessel; and a pump interconnecting said outlet line and said inlet line for circulating liquid carbon dioxide cleaning medium through said wash vessel.

12. An apparatus according to claim 11, wherein said pump is a centrifugal pump.

13. A method of operating a cleaning apparatus adapted for cleaning fabrics and garments with a liquid carbon dioxide cleaning medium, the apparatus comprising a wash vessel having a wall portion, a rotating basket positioned in said wash vessel, and a drive shaft penetrating said wash vessel wall portion, said shaft operatively associated with said rotating basket; said method comprising:

providing a double mechanical seal connected to said wall portion with said drive shaft passing therethrough;

filling said double mechanical seal with -a seal liquid, said seal liquid comprising an organic co-solvent;

increasing the pressure in said wash vessel so that articles therein can be cleaned in a liquid carbon dioxide cleaning medium therein pressurizing said seal liquid for at least the time when the pressure in said wash vessel is increased, so that the escape of liquid carbon dioxide cleaning medium around said rotating shaft is reduced; and circulating a liquid carbon dioxide cleaning medium through said wash vessel to clean articles therein, wherein said liquid carbon dioxide cleaning medium comprises an organic co-solvent;

said organic co-solvent in said carbon dioxide cleaning medium and the organic co-solvent in said seal liquid are the same; and with said seal liquid flowing into said wash vessel.

14. A method according to claim 13, wherein said organic co-solvent is soluble in said liquid carbon dioxide cleaning medium.

15. A method according to claim 13, wherein said surfactant is soluble in said seal liquid.

16. A method according to claim 13, wherein:

said liquid carbon dioxide cleaning medium further comprises a surfactant, said seal liquid further comprises a surfactant, and said cleaning medium surfactant and said seql liquid surfactant are the same.

17. A method according to claim 13, further comprising the step of rotating said basket by rotating said shaft while circulating said liquid carbon dioxide cleaning medium through said wash vessel.

* * * * *